US005794994A

United States Patent [19]

Miyagawa et al.

[11] Patent Number: 5,794,994

[45] Date of Patent: Aug. 18, 1998

[54] INSIDE DOOR HANDLE UNIT FOR AUTOMOTIVE VEHICLE

[75] Inventors: Masazumi Miyagawa, Yokohama; Satoru Nishizawa, Yokosuka; Takayuki Sano, Fujisawa, all of Japan

[73] Assignees: OHI Seisakusho Co., Ltd.; Nissan Motor Co., Ltd., both of Yokohama, Japan

[21] Appl. No.: 693,527

[22] Filed: Aug. 8, 1996

[51] Int. Cl.[6] ..... E05B 3/00

[52] U.S. Cl. ..... 292/336.3; 292/347; 292/DIG. 31

[58] Field of Search ..... 292/336.3, 347, 292/DIG. 31, DIG. 53

[56] References Cited

U.S. PATENT DOCUMENTS

| | | | |
|---|---|---|---|
| 4,580,822 | 4/1986 | Fukumoto | 292/DIG. 31 X |
| 4,858,973 | 8/1989 | Ogasawara et al. | 292/347 |
| 4,889,373 | 12/1989 | Ward et al. | 292/DIG. 31 X |
| 5,011,202 | 4/1991 | Kato et al. | 292/DIG. 31 X |
| 5,183,302 | 2/1993 | Pelachyk et al. | 292/DIG. 53 X |
| 5,263,750 | 11/1993 | Smith et al. | 292/336.3 |

FOREIGN PATENT DOCUMENTS

| | | |
|---|---|---|
| 5-29309 | 7/1993 | Japan . |
| 2 216 406 | 10/1989 | United Kingdom . |

*Primary Examiner*—Rodney M. Lindsey
*Attorney, Agent, or Firm*—Foley & Lardner

[57] ABSTRACT

An inside door handle unit to be installed to the inside surface of a door of an automotive vehicle. The inside door handle unit includes a body attached to the door of the vehicle. An inside door handle is rotatably supported to the body and pivotal around an axis. A door lock knob is rotatably supported to the body and pivotal around the axis. The handle and the door lock knob are connected to the door lock device. A spring is provided to bias the handle in one rotational direction of the handle. The handle is rotatably supported relative to the body under the action of a fitting connection between the counterpart device of the body and the counterpart device of the handle, while the lock knob is rotatably supported relative to the body under the action of another fitting connection between the counterpart device of the body and the counterpart device of the lock knob. The handle and the lock knob are independently rotatably supported on the body.

9 Claims, 9 Drawing Sheets

INSIDE DOOR HANDLE UNIT FOR AUTOMOTIVE VEHICLE

BACKGROUND OF THE INVENTION

1. Field of the Invention

This invention relates to improvements in an inside door handle unit for an automotive vehicle, and more particularly to the inside door handle which is improved in operational efficiency in assembly while preventing component parts from producing their play.

2. Description of the Prior Art

A variety of inside door handle units have been hitherto proposed and put into practical use. One of them is disclosed in Japanese Utility Model Publication No. 5-29309. In this inside door handle unit, an inside door handle and a door lock knob which are connected to a door lock device are rotatably pivotally supported to a body fixed to a door of an automotive vehicle without requiring a special or separate rotational shaft arrangement. More specifically, the handle is rotatably supported to the body under the action of a fitting connection between a hole and a projection which are brought into fitting with each other upon an elastic snap-action. The lock knob is rotatably supported to the handle under the action of a fitting connection between a hole and a projection which are brought into fitting with each other upon an elastic snap-action. Additionally, a spring is disposed inside the lock knob to bias the handle in one rotational direction.

However, difficulties have been encountered in the above conventional inside door handle unit. That is, the handle is pivotally supported to the body, and the lock knob is pivotally supported to the handle. Consequently, a play tends to be produced particularly in the lock knob under a dimensional irregularity of the three parts (the body, the handle and the lock knob). It has been difficult to control the dimensional precision of the three parts in a manner to avoid production of the play. Besides, there is the fear that the spring disposed inside the lock knob is brought into contact with the inner surface of the lock knob upon deformation during operation of the handle thereby degrading the operationability of the lock knob. Furthermore, it is required to obtain a space for storing the spring inside the lock knob upon taking account of the elastic deformation of the lock knob itself during installation of the lock knob. This invites making the lock knob large-sized.

SUMMARY OF THE INVENTION

It is an object of the present invention to provide an improved inside door handle unit for an automotive vehicle, which can effectively overcome the difficulties encountered in conventional inside door handle units.

Another object of the present invention is to provide an improved inside door handle unit for an automotive vehicle, by which an inside door handle and a door lock knob can be installed to a body without making a play, while improving an operational efficiency in assembly.

An inside door handle unit of the present invention is for an automotive vehicle and comprises a body attached to a door of the vehicle. An inside door handle is rotatably supported to the body and pivotal around an axis. The handle is connected to a door lock device. A door lock knob is rotatably supported to the body and pivotal around an axis. The door lock knob is connected to the door lock device. A spring is provided to bias the handle in one rotational direction of the handle. A first pivot mechanism is provided including first and second counterpart devices which are rotatably engageable with each other to provide a first pivotal connection. The first and second counterpart devices form part respectively of the body and handle and located at a first side of the inside door handle unit. The first pivot mechanism further includes third and fourth counterpart devices which are rotatably engageable with each other to provide a second pivotal connection. The third and fourth counterpart devices form part respectively of the body and handle and located at a second side of the inside door handle unit. The second side is opposite to the first side. The first to fourth counterpart devices are located on the axis around which the handle is pivotal. A second pivot mechanism is provided including fifth and sixth counterpart devices which are rotatably engageable with each other to provide a third pivotal connection. The fifth and sixth counterpart devices form part respectively of the body and the lock knob and located at the first side of the inside door handle unit. The second pivot mechanism further includes seventh and eighth counterpart devices which are rotatably engageable with each other to provide a fourth pivotal connection. The seventh and eighth counterpart devices form part respectively of the body and the lock knob and located at the second side of the inside door handle unit. The fifth to eighth counterpart devices are located on the axis around which the lock knob is pivotal.

Accordingly, the handle is rotatably supported relative to the body under the action of the fitting connection between the counterpart device of the body and the counterpart device of the handle, while the lock knob are rotatably supported relative to the body under the action of the fitting connection between the counterpart device of the body and the counterpart device of the lock knob. Consequently, the handle and the lock knob are independently rotatably supported on the body, and therefore the handle can be securely prevented from producing its play under a precision control for the two pans or the body and the handle while the lock knob can be securely prevented from producing its play under a precision control for the two parts or the body and the lock knob.

DETAILED DESCRIPTION OF THE INVENTION

Figure 1:
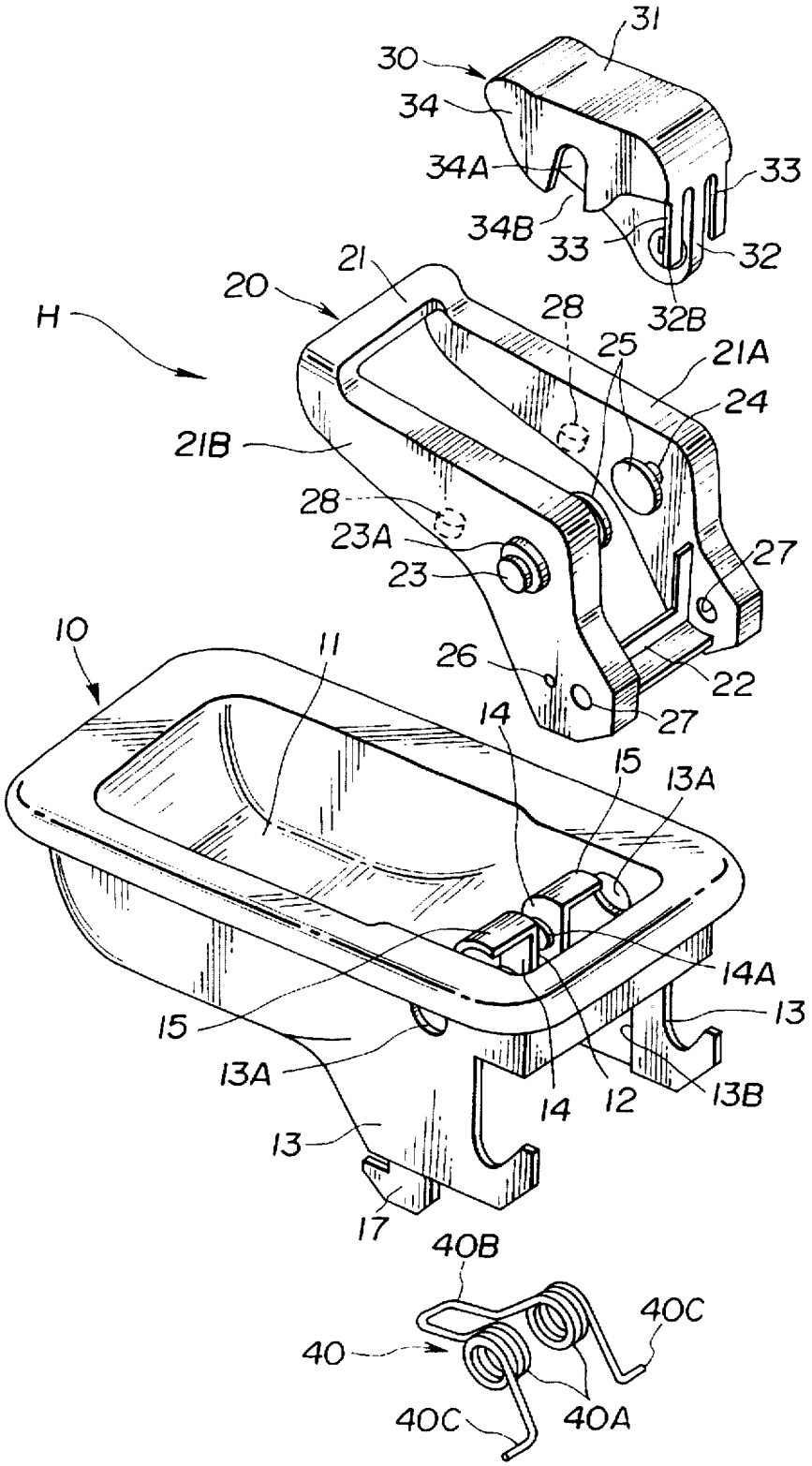
FIG. 1 is an exploded perspective view of an embodiment of an inside door handle unit according to the present invention.
Figure 2:
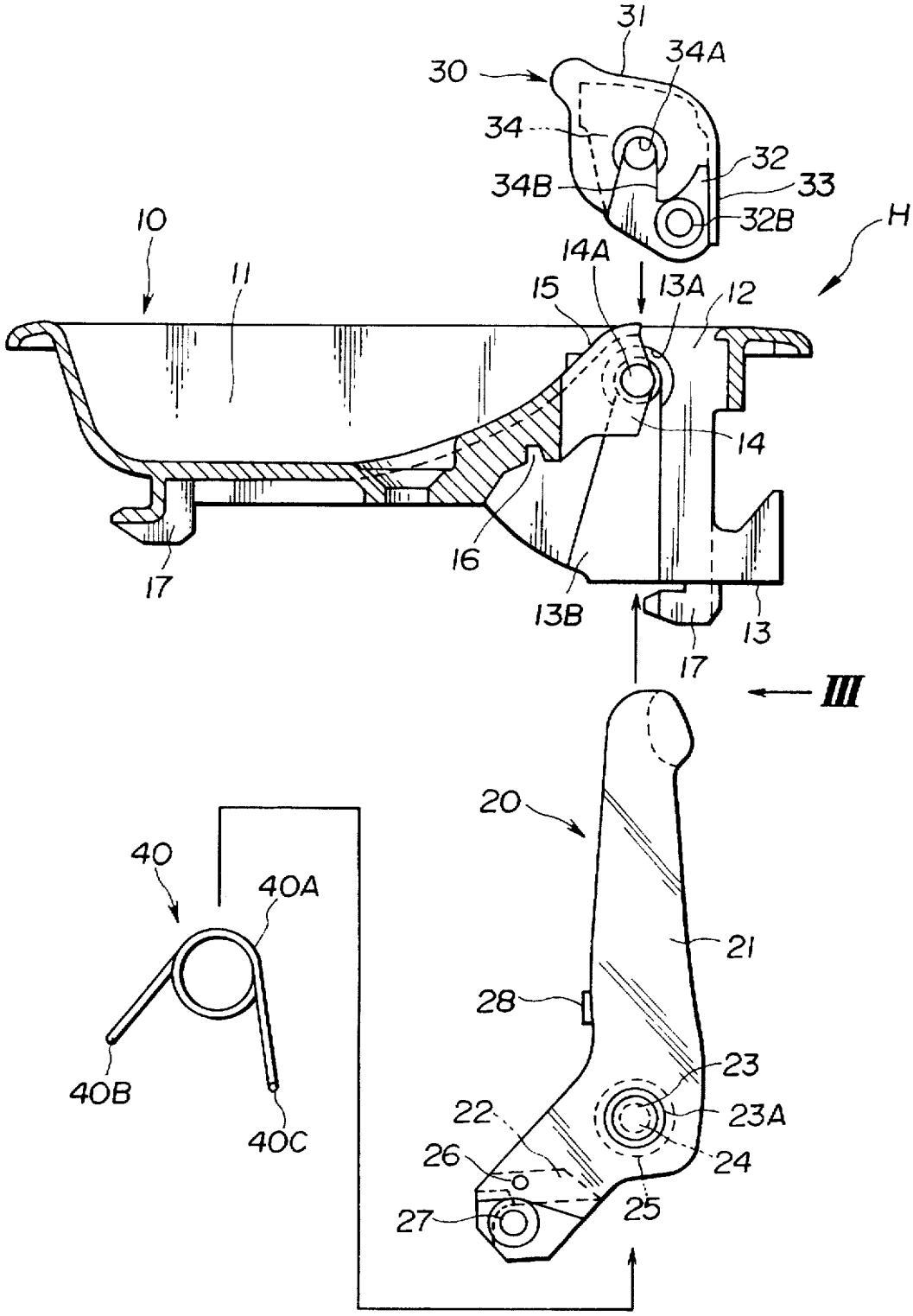
FIG. 2 is an exploded side view (partly in section) of the inside door handle unit of FIG. 1, showing an assembly manner of the inside door handle unit.
Figure 3:
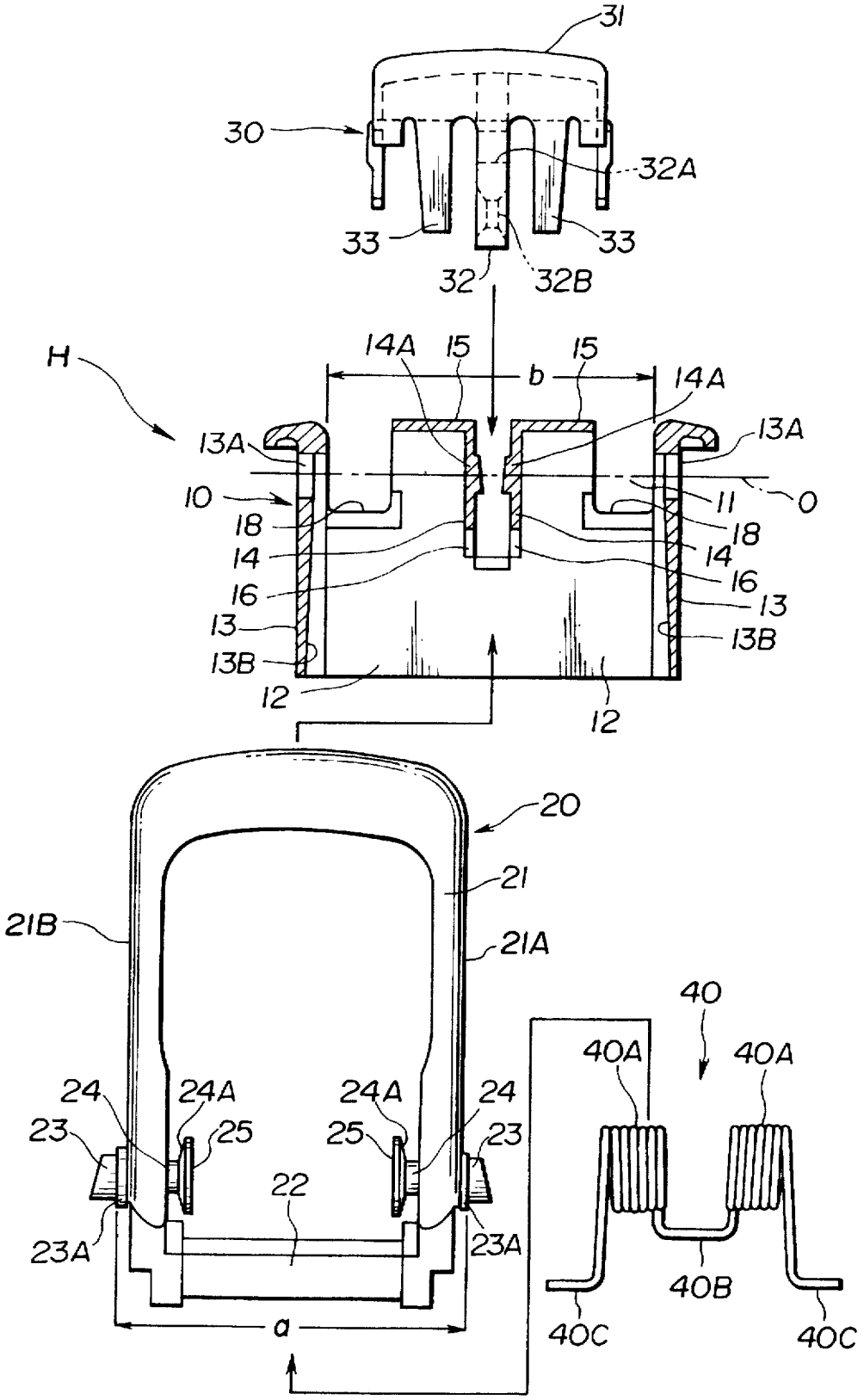
FIG. 3 is another exploded side view (partly in section) of the inside door handle unit of FIG. 1 as viewed from a direction III of FIG. 3, showing the assembly manner of the inside door handle unit.

Referring now to FIGS. 1 to 3 of the drawings, an embodiment of an inside door handle unit according to the present invention is illustrated by the reference numeral H. The inside door handle unit H of this embodiment is used for a door 1 (in FIG. 5) of an automotive vehicle and comprises a body 10 which is fixed to the door and formed of plastic. The body 10 is formed generally bathtub-shaped and formed at its tub-shaped section 11 with a though-hole 12 which is located at a position near a one end of the body 10. Opposite right and left-side side wall sections 13 of the body 10 are integral with an end portion of the tub-shaped section 11 and extend downward so that the through-hole 12 is located between them. The side wall sections 13 are respectively formed with opposite right and left-side circular holes 13A to be pivotally connected to an inside door handle 20. Each side wall section 13 is formed partly thin so that an inclined surface 13B (inclined relative to an imaginary vertical plane in FIG. 3) is formed at the inner surface thereof within a region from its bottom end to the circular hole 13A as best seen in FIG. 3.

Opposite right and left-side pivotal-support piece sections 14 are formed integral with the tub-shaped section 11 and located at an edge portion (located at the right and left-side edge in FIG. 2) of the tub-shaped section 11, defining the through-hole 12. The pivotal-support piece sections 14 are respectively formed with right and left-side pivot projections 14A which are generally column-shaped and located opposite to each other to be pivotally connected to a door lock knob 30. The pivot projections 14A are spaced from and coaxial with each other as shown in FIG. 3. The pivot projections 14A are coaxial with the circular holes 13A in such a manner that a common axis O passes through the circular holes 13A and the pivot projections 14A as clearly shown in FIG. 3. Each pivot projection 14A is formed at its tip end with an inclined end surface which is flat and not perpendicular to the axis O as shown in FIG. 3. Additionally, the body 10 includes opposite right and left-side cover sections 15 which are respectively integral with the pivot-support sections 14 and integral with the tub-shaped section 11. An engagement groove 16 for a spring 40 is formed throughout the pivotal-support sections 14 are formed. The body 10 is further provided with hook sections 17 through which the body 10 is fixed to a rigid part of the door.

The handle 20 is formed of plastic and includes a generally U-shaped main body section 21 which has right and left-side leg portions 21A, 21B disposed spacedly opposite to each other. A bridge section 22 is formed between the leg portions 21A, 21B at their base end part (not identified), so that the handle 20 takes a generally rectangular frame-shape. The leg portions 21A, 21B are respectively provided with projections 23 which are located opposite to each other and project outwardly from the outer-side surface of the leg portions 21A, 21B. The projections 23 are rotatably insertable respectively in the circular holes 13A of the body 10 thereby forming a first pivotal-support mechanism (not identified) through which the handle 20 is rotatably supported by the body 10. Each projection 23 includes an annular flange section 23A located contiguous with the outer-side surface of each leg portion 21A, 21B so that each projection 23 is formed generally step-like. Here, a distance a between the annular flat surfaces of the respective right and left-side flange sections 23A is set slightly larger than a distance b between the surfaces of the inner opposite side-walls of the tub-shaped section 11, the circular holes 13A being formed respectively in the inner opposite side walls, as shown in FIG. 3. The tip end surface of each projection 23 is formed inclined to form an inclined tip end surface which is not perpendicular to an imaginary common axis (not shown) passing through the opposite projections 23, the common axis corresponds to the axis O (in FIG. 3) upon being assembled with the body 10. Right and left-side guide projections 24 are formed projecting from the inside surfaces of the leg portions 21A, 21B of the main body section 21. Each guide projection 24 is column-like and projects inwardly and provided at its tip end with a disc-shaped restriction wall 25 (for the spring 40). The restriction wall 25 is integrally connected to the tip end of the guide projection 24 through a generally frustoconical inclined section 24A as shown in FIG. 3.

Figure 6:
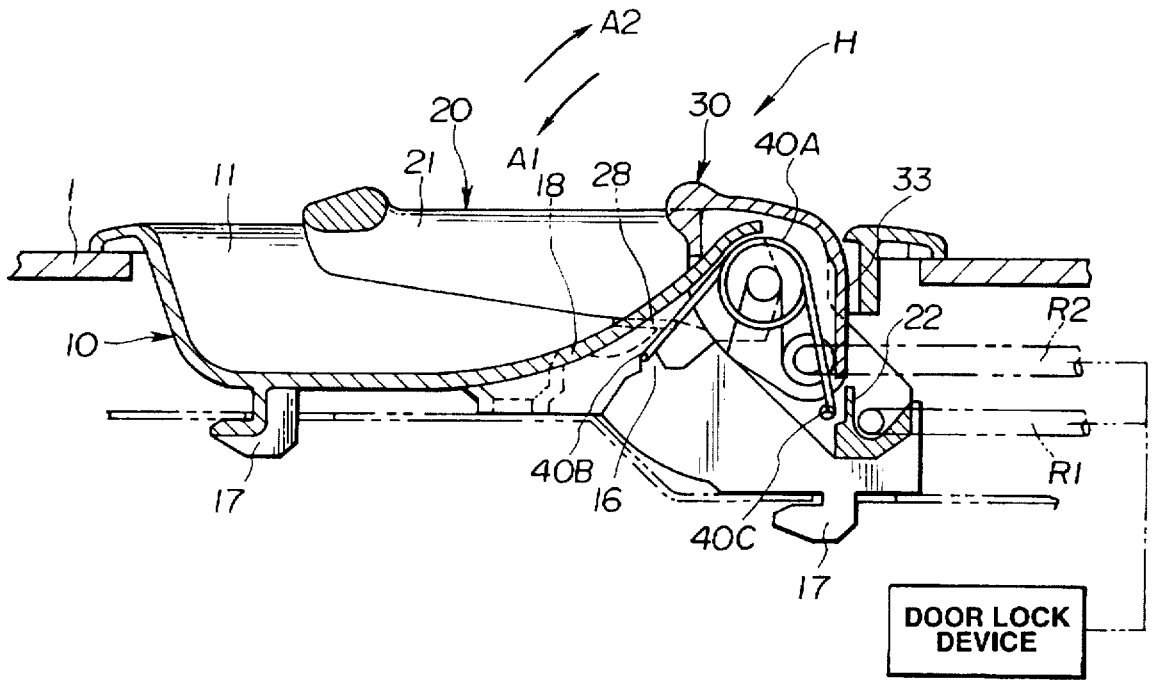
FIG. 6 is an enlarged sectional view taken in the direction of arrows substantially along the line VI—VI of FIG. 5, showing an operational mode.

Each of the right and left-side leg portions 21A, 21B is formed at its base end part with an engagement hole 26 in which an end section of the spring 40 is engageable, and with a connection hole 27 into which a rod R1 connected to a door lock device (not shown) is inserted in an engaging member. The tip end section of the rod R1 is bent generally L-shaped and to be inserted into either one of the two connection holes 27 formed respectively in the right and left leg portions 21A, 21B so that the rod R1 is pivotally connected to the leg portion 21A, 21B as shown in FIG. 6.

The door lock knob 30 is formed of plastic and includes a surface section 31 having a suitable thickness. A leg section 32 of the generally plate-shape is formed integral with the surface section 31 and projects downward from the inner surface of the surface section 31. The leg section 32 is located at the laterally central part of the inner surface of the surface section 31 so as to be inserted between the right and left pivot-support piece sections 14 of the body 10. As best seen in FIG. 3, the leg section 32 is formed at its upper part with an hole 32A into which the pivot projections 14A are to be inserted thus constituting a second pivot support mechanism (not identified) for pivotally supporting the lock knob 30 to the body 10. Additionally, the leg section 32 is formed at its lower part with a connection hole 32B into which the end section of a rod R2 (in FIG. 6) connected to the door lock device is to be inserted so that the lock knob 30 is connected to the door lock device. The end section of the rod R2 is bent to be generally L-shaped and to be inserted into the connection hole 32B from either one of the right and left openings formed at the right and left-side surfaces of the leg section 32 so that the end section of the rod R2 is to be engaged with the leg section 32 of the lock knob 30.

The lock knob 30 includes right and left-side tongue sections 33 which are formed to extend downward from the end portion (located at the left-side in FIG. 2) of the surface section 31 and located such that the leg section 32 is between the tongue sections 33. The end section of the rod R2 engaged in the connection hole 32B is to be positioned between one of the tongue sections 33 and the leg section 32 so as to be restricted in a right and left directional movement. Accordingly, the tongue sections 33 constitutes a coming-out preventing mechanism (not identified) for preventing the end section of the rod R2 from coming out of the connection hole 32B. Additionally, the lock knob 30 includes right and left-side side wall sections 34 which are integral with the surface section 31 and extend downward from the side edge parts of the surface section 31. Each side wall section 34 is formed with a cutout (not identified) extending to the lower edge of the side wall section 34, the cutout including a guide section 34A and a downward extending section 34B reaching the lower edge of the side wall section 34. An edge portion (of the side wall section 34) defining the guide section 34A is engaged with the guide projection 24 of the handle 20 so that the lock knob 30 is to be guided by the guide projections 24. The width of the extending section 34B gradually increases in a direction away from the guide section 34A.

The spring 40 is of the helical torsion spring type and formed symmetrical. The spring 40 includes right and left-side coil sections 40A which are formed coaxial with and separate from each other. The coil sections 40A are to be located respectively within the cover sections 15. The coil sections 40A are connected with each other through an intermediate section 40B which is to be engaged with the engagement groove 16 of the body 10. End sections 40C extend respectively from the right and left-side coil sections 40A and arranged to be engaged in the engagement holes 26 of the handle 20.

Figure 4:
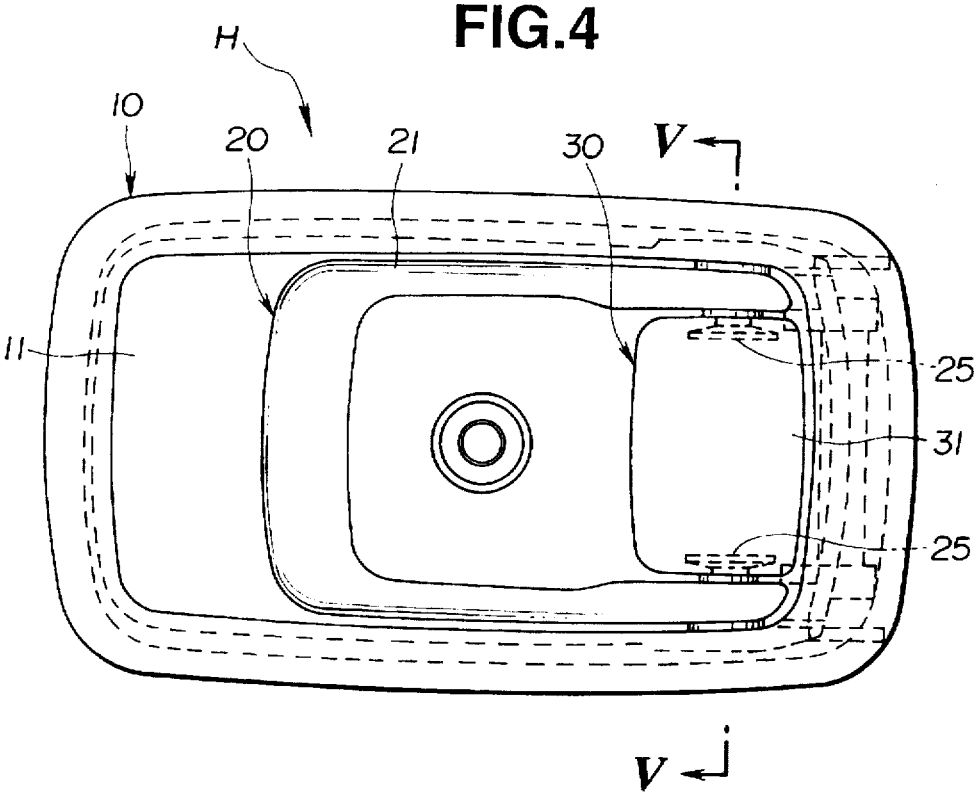
FIG. 4 is a plan view of the inside door handle unit of FIG. 1.
Figure 5:
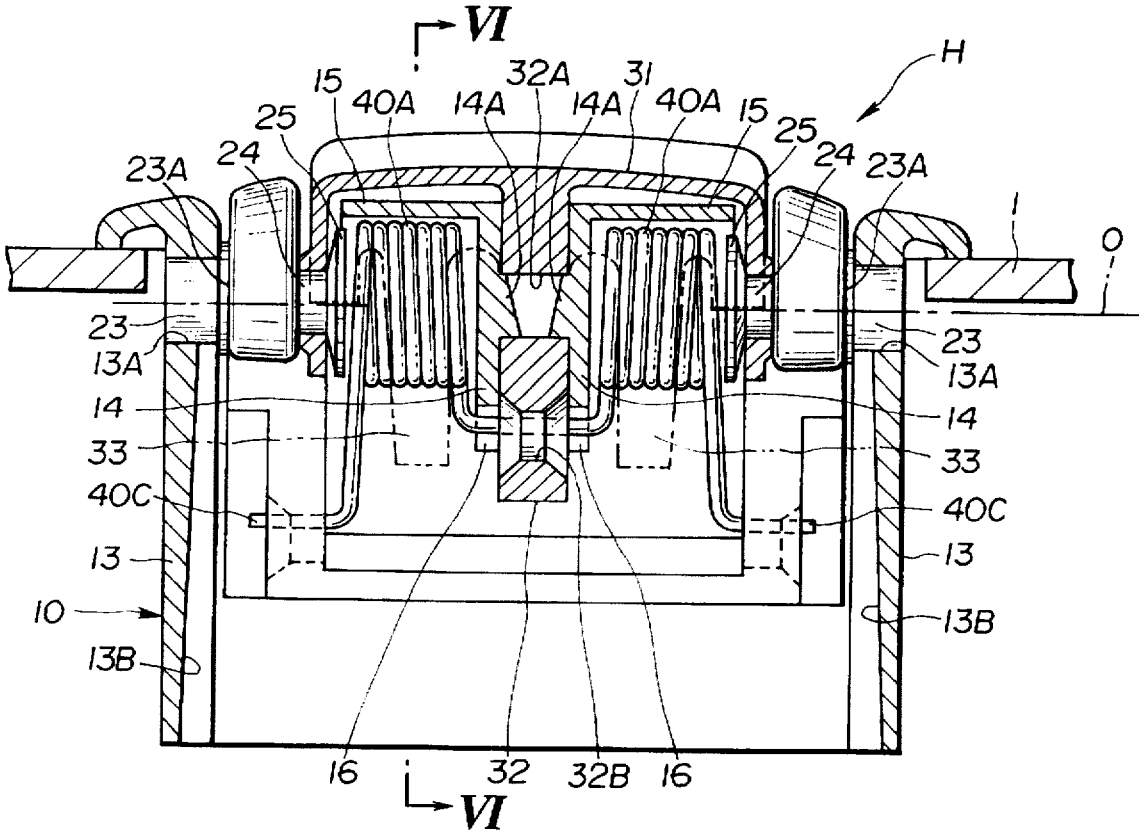
FIG. 5 is an enlarged sectional view taken in the direction of arrows substantially along the line V—V of FIG. 4.

Next, the procedure of assembling the inside door handle unit H will be discussed also with reference to FIGS. 4 to 6.

First, as shown in FIGS. 2 and 3, the handle 20 is put into a state to generally vertically extend upon the bridge section 22 being located below. The handle 20 in this state is inserted from the lower side into the through-hole 12 of the body 10 and moved upwardly in a manner that the projections 23 slide along the inclined surfaces 13B of the body 10 to come into engagement with the circular holes 13A. At this time, each projection 23 can be smoothly inserted into the circular hole 13A under the action of the inclined tip end surface of each projection 23 and the inclined surfaces 13B. Until the projections 23 have been brought into fitting in the circular holes 13A, the body 10 and the handle 20 are compulsorily elastically deformed. When each projection 23 is brought into facing to the circular hole 13A, the projection 23 is fitted in the circular hole 13A under the snap-action due to elastic restoration of the body 10 and the handle 20. Thus, the handle 20 is supported rotatable around the axis O relative to the body 10. It will be understood that the flange section 23A of each projection 23 is in contact with the inner surface of the tub-shaped section 11 of the body 10 so that the annular surface of the flange section 23A serves as a sliding surface which is in sliding contact with the body 10.

Thereafter, also as shown in FIGS. 2 and 3, the lock knob 30 is inserted from the upper side into the through-hole 12 of the body 10 in such a manner as to be guided through the extended section 34B of the cutout of the lock knob 30, so that leg section 32 is inserted between the right and left-side pivot-support piece sections 14 of the body 10 thereby allowing the pivot projections 14A to come into fitting in the hole 32A. At this time, each guide projection 24 can be smoothly brought into fitting in the guide section 34A since the cutout of the lock knob 30 is formed to increase in width in the direction toward the bottom of the lock knob 30. As a result, the lock knob 30 is inserted in position while being guided, in which the leg section 32 of the lock knob 30 is smoothly inserted between the right and left-side pivot-support piece sections 14 under assistance due to the fact that the tip end surface of each pivot projection 14A is inclined. Until the pivot projections 14A have been brought into fitting in the hole 32A, the pivot-support piece sections 14 are compulsorily elastically deformed so that the pivot projections 14A come into fitting in the hole 32A under the snap-action of elastic restoration of the pivot-support piece sections 14 when the hole 32A is brought into facing to the pivot projections 14A. Thus, the lock knob 30 is rotatably supported around the axis O relative to the body 10, in which the lock knob 30 can be prevented from producing a play relative to the handle 20 by virtue of the right and left guide projections 24 of the handle 20.

Immediately before and after the lock knob 30 is attached to the body 10, the spring 40 is installed in position. More specifically, also as shown in FIGS. 2 and 3, the spring 40 is inserted from the lower side into the through-hole 12 of the body 10 in such a manner that the right and left-side coil sections 40A are located respectively under the right and left-side cover sections 15 of the body 10; the intermediate section 40B is engaged in the engagement groove 16 of the body 10; and the right and left-side end sections 40C are respectively brought into engagement with the corresponding right and left-side engagement holes 26 of the handle 20. The thus set spring 40 biases the handle 20 rotationally in a direction of an arrow A1 in FIG. 6 under the biasing force of the spring 40.

Figure 7:
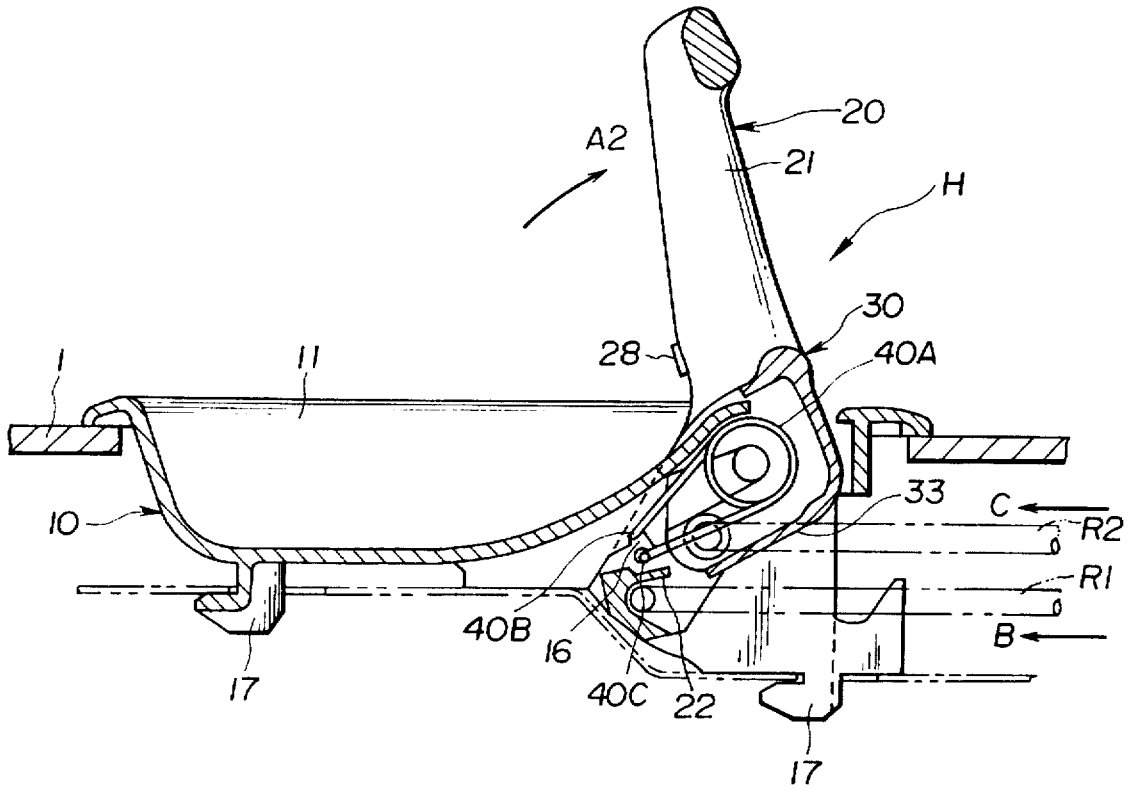
FIG. 7 is an enlarged sectional view similar to FIG. 6 but showing another operational mode.

The thus assembled inside door handle unit H is installed to the door 1 of the automotive vehicle as shown in FIG. 6 in which the hook sections 17 is fixed to the rigid part (indicated in phantom) of the door 1, in which the handle 20 and the lock knob 30 are connected to the door lock device respectively through the rods R1, R2. The handle 20 is normally in a position shown in FIG. 6 which position corresponds to the moving limit in a rotational direction of an arrow A2, in which stopper sections 28 are brought into contact with flat sections 18 tin FIG. 3) of the body 10 as shown in FIG. 6. When the handle 20 is moved rotationally in the direction of the arrow A2 in FIG. 6, the rod R1 is operated to be pulled in a direction of an arrow B as shown in FIG. 7. Similarly, when the lock knob 30 is moved rotationally in the direction of the arrow A2 in FIG. 6, the rod R2 is operated to be pulled in a direction of an arrow C as shown in FIG. 7. Thus, the handle 20 and the lock knob 30 can be independently rotationally operated.

Advantageous effects of the above arranged inside door handle unit H will be discussed hereinafter.

The handle 20 is rotatably supported relative to the body 10 under the fitting connection between the circular holes 13A of the body 10 and the projections 23 of the handle 20, while the lock knob 30 are rotatably supported relative to the body 10 under the fitting connection between the pivot projections 14A of the body 10 and the hole 32 of the lock knob 30. Consequently, the handle 20 and the lock knob 30 are independently rotatably supported on the body 10, and therefore the handle 20 can be securely prevented from making its play under a precision control for the two parts or the body 10 and the handle 20 while the lock knob 30 can be securely prevented from making its play under a precision control for the two part or the body 10 and the lock knob 30. Furthermore, the handle 20 and the lock knob 30 can be independently rotationally operated without causing an interference therebetween, and therefore one of them can be prevented from being unnecessarily rotationally moved together with the other during a rotational movement of the other. Moreover, the lock knob 30 can be further prevented from making its play under the action of the guide projections 24 of the handle 20 and the guide section 34A of the cutout of the lock knob 30.

Since the cover sections 15 cover respectively the coil sections 40A of the spring 40, an external appearance of the inside door handle unit H is improved while narrowing a clearance thereby effectively preventing air within a passenger compartment from leaking to the outside of the door. Further, movement of the spring 40 can be restricted by the restriction walls 25 of the handle 20, and accordingly interference between the spring 40 and the lock knob 30 can be avoided.

Besides, the handle 20 is formed to be generally rectangular frame-shaped under use of the bridge section 22, and therefore the rigidity of the handle 20 can be improved while allowing the elastic deformation amount of the handle 20 to be set at a high value thereby improving the operational efficiency for installation of the handle 20 and thereby increasing the degree of engagement in the pivotal-support sections so as to improve an engagement strength. The rigidity and the elastic deformation amount of the handle 20 may be set in accordance with the cross-sectional shape or the like of the bridge section 22 of the handle 20.

FIGS. 8 to 12 illustrate another embodiment of the inside door handle unit H according to the present invention, which is similar to the above discussed embodiment of FIGS. 1 to 1 to 7 substantially except for the structure of the door lock knob 30.

In this embodiment, the leg section 32 of the generally plate-shape is formed with the hole 32A for the pivot projections 14A and the connection hole 32B for the rod R2. The hole 32A and the hole 32B are arranged such that an imaginary vertical plane V1 containing the axis of the hole 32A is separate from an imaginary vertical plane V2 containing the axis of the hole 32B are separate from each other in FIG. 8, in which the vertical planes V1, V2 are parallel with each other. Two first projections or ribs 45, 45 are formed integral with the leg section 32 and located respectively at the opposite side surfaces of the leg section 32 in such a manner that each first projection 45 projects from each side surface of the leg section 32. Each first projection 45 is formed in the shape of an elongate plate and extends vertically from the surface section 31 in FIG. 8. Each first projection 45 is located between the holes 34A and 32B and parallel with the imaginary vertical planes V1, V2. More specifically, each projection 45 has opposite flat surfaces (not identified) one of which is adjacent the hole 34A and the other adjacent the hole 32B.

Additionally, two second projections or ribs 46, 46 are formed integral with the leg section 32 and located respectively at the opposite side surfaces of the leg section 32 in such a manner that each second projection 46 projects from each side surface of the leg section 32. Each second projection 46 is formed in the shape of an elongate plate and extends vertically from the surface section 31 in FIG. 8. Each second projection 46 is formed parallel and adjacent the first projection 45 and located above the hole 32B in FIG. 8.

Further, two third projections or ribs 47, 47 are formed integral with the leg section 32 and located respectively at the opposite side surfaces of the leg section 32 in such a manner that each third projection 47 projects from each side surface of the leg section 32. Each third projection 47 is formed in the shape of an elongate plate and extends vertically from the surface section 31. Each third projection 47 is formed parallel and adjacent the second projection 46 and located adjacent the right-side end of the leg section 32 in FIG. 8.

Figure 8:
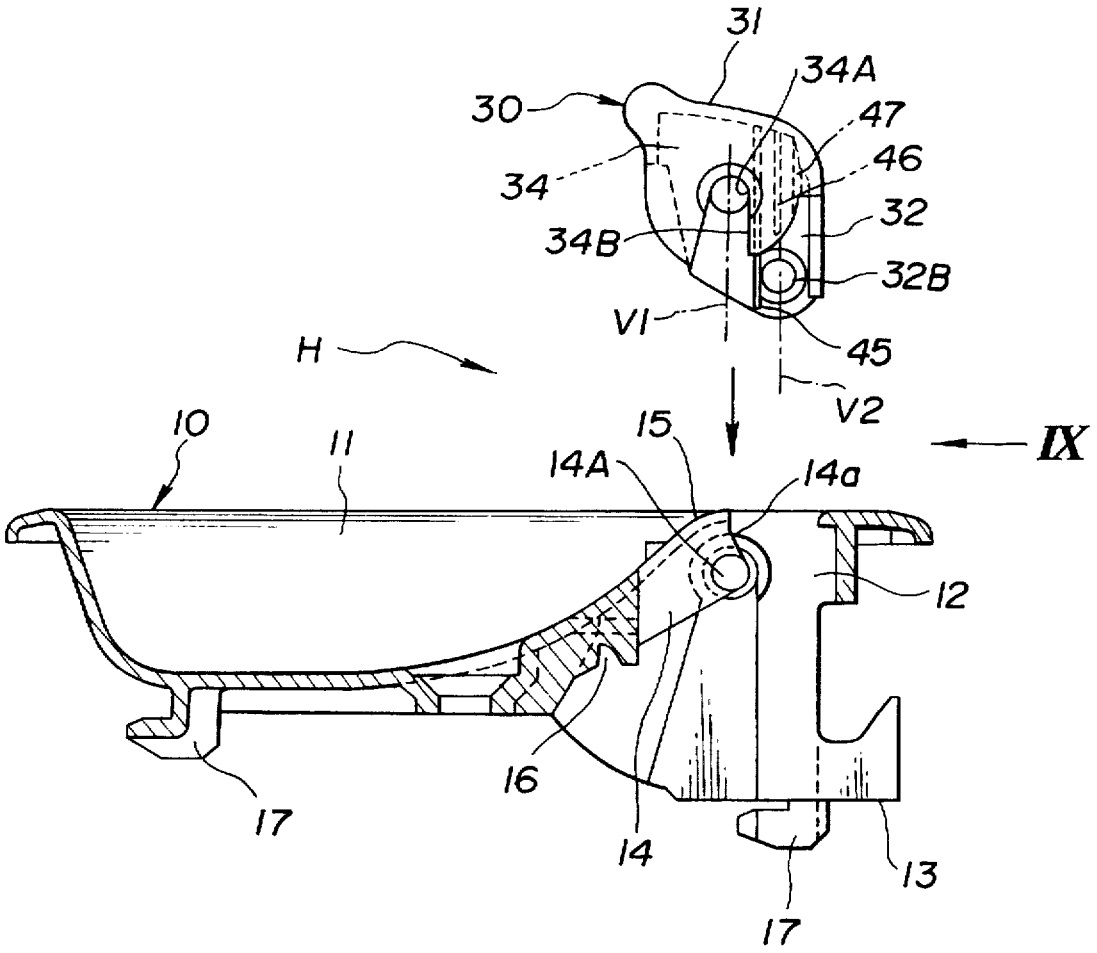
FIG. 8 is an exploded side view (party in section) of an essential part of another embodiment of the inside door handle unit according to the present invention, showing an assembly manner of the inside door handle unit.
Figure 9:
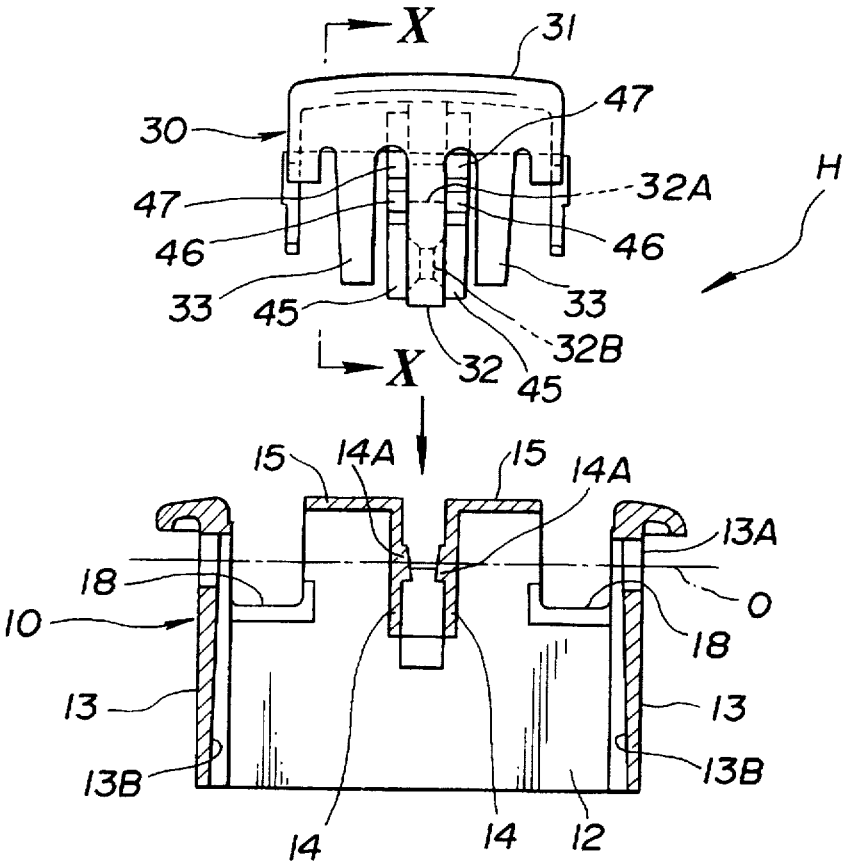
FIG. 9 is another exploded side view (partly in section) of the inside door handle unit of FIG. 8 as viewed from a direction IX of FIG. 8, showing the assembly manner of the inside door handle unit.
Figure 10:
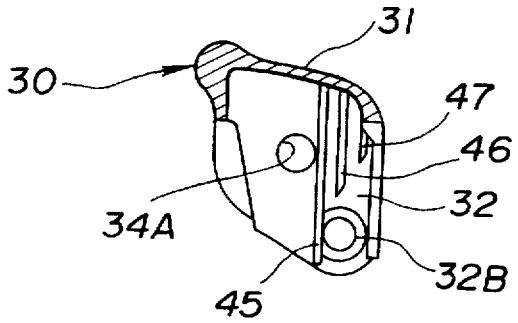
FIG. 10 is a sectional view as taken in the direction of arrows substantially along the line X—X of FIG. 9.

In this embodiment, as best shown in FIG. 8, each pivotal-support piece section 14 of the body 10 is slightly cut out at a portion located below the pivot projection 14A, which will be apparent in comparison with the corresponding part of the first embodiment in FIG. 2. This cutting-out is made for the purpose of avoiding an interference between the pivotal-support piece section 14 and at least the first projection 45.

Figure 11:
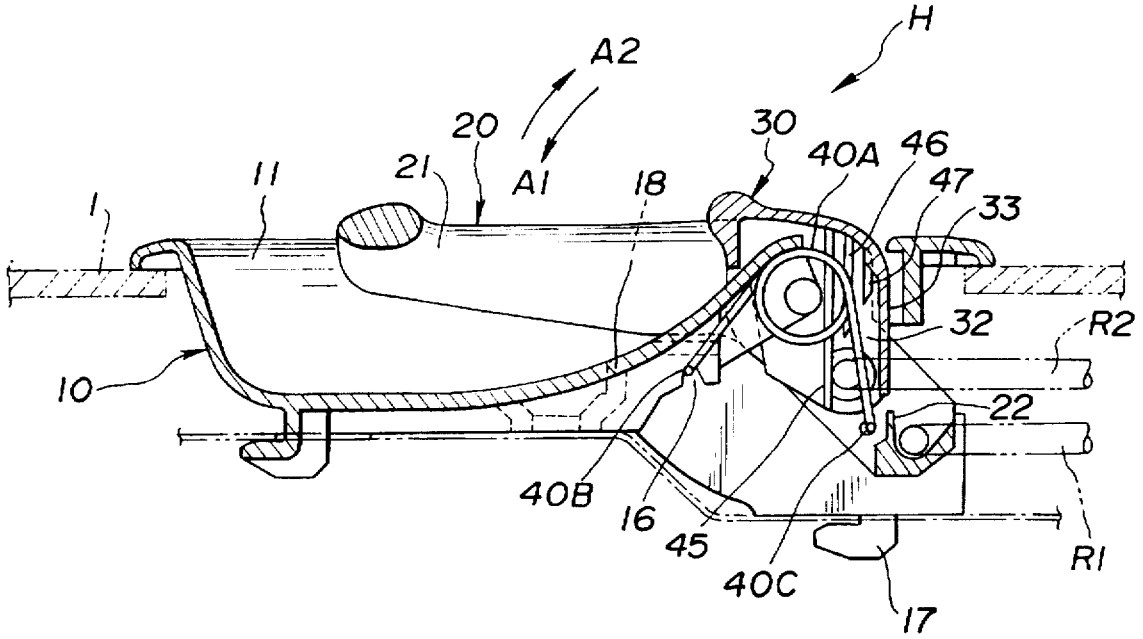
FIG. 11 is an enlarged sectional view similar to FIG. 6 but showing an operational mode of the inside door handle unit of FIG. 8.
Figure 12:
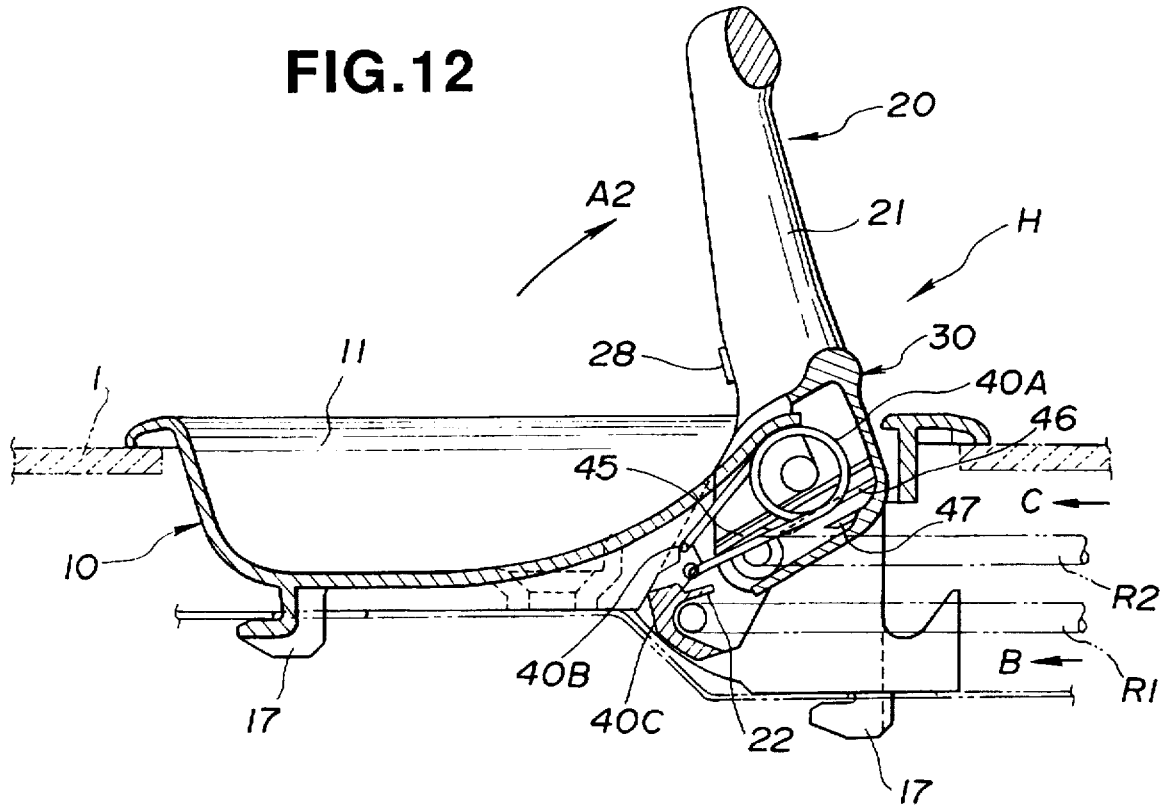
FIG. 12 is an enlarged sectional view similar to FIG. 7 but showing another operational mode of the inside door handle unit of FIG. 8.

As shown in FIGS. 11 and 12, the inside door handle unit H of this embodiment operates in the same manner as that of the first embodiment so that FIGS. 11 and 12 correspond respectively to FIGS. 6 and 7 of the first embodiments.

By virtue of the first projections 45, the lock knob 30 can be smoothly assembled in the body 10 from the upper side as shown in FIG. 8. More specifically, during an assembly operation, each first projection 45 is brought into slidable contact with an end guide portion **14*a* of the pivotal-support piece section 14 so that the lock knob 30 is slidingly guided into position. Additionally, when the end section of the rod R2 is inserted into the hole 32B, the end section is smoothly guided into the hole 32B upon striking against the lower part of the first projection 45. In this connection, such an insertion operation of the rod R2 is further assisted by the second and third projections 46, 47, in which the second and third projections 46, 47 can smoothly guide the end section of the rod R2 downward in FIG. 8 when the end section of the rod R2 first strikes against the second or third projection 46, 47 before coming into contact with the first projection 45**.

While the holes 13A of the body 10 and the hole 32A of the lock knob 30 have been shown and described as being formed respectively in the body 10 and the lock knob 30 in the above embodiments, it will be appreciated that the holes 13A may be replaced with depressions into which the projections 23 are respectively invertable while the hole 32A may be replaced with depressions into which pivot projections 14A are respectively insertable.

While each circular hole 13A and each projection 23 for rotatably supporting the handle 20 to the body 10 have been shown and described as being formed respectively in the body 10 and the handle 20 in the above embodiments, it will be appreciated that the circular hole 13A and the projection 23 may be formed respectively in the handle 20 and the body 10. Similarly, while each pivot projection 14A and each hole 32A for rotatably supporting the lock knob 30 to the body 10 have been shown and described as being formed respectively in the body 10 and the lock knob 30, it will be appreciated that the pivot projection 14A and the hole 32A may be formed respectively in the lock knob 30 and the body 10. Thus, it is essential that the handle 20 and the lock knob 30 are independently rotatably supported to the body 10 through the independent pivot-support mechanism.

Figure 13:
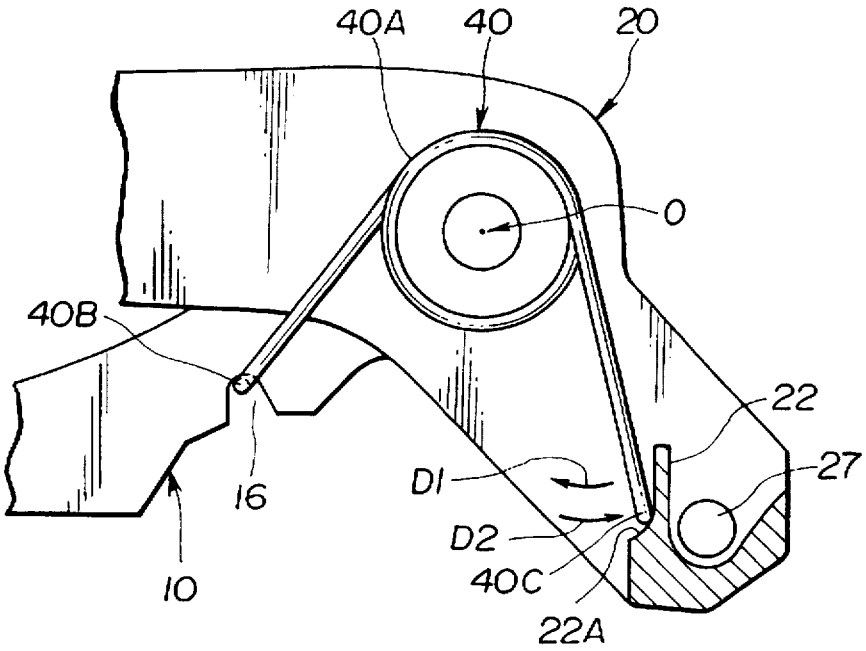
FIG. 13 is an enlarged fragmentary side view of an essential part of a modified example of the inside door handle unit according to the present invention, showing an installation structure for a spring.

Although the end sections 40C of the spring 40 has been shown and described as being inserted in the holes 26 of the handle 20 in the above embodiments, it will be understood that they 40C may be engaged with a step portion 22A of the bridge section 22 of the handle 20 as shown in FIG. 13. With this arrangement, when the spring 40 is installed in position from the lower side in FIG. 13, the end sections 40C are temporarily deformed in a direction of an arrow D1, upon which the end sections 40C can be readily brought into engagement with the step section 22A under the snap action in a direction of an arrow D2 due to elastic restoring force of the end sections 40C. In other words, the spring 40 can be readily installed in position merely by being thrust upwardly from the lower side in FIG. 13.

What is claimed is:

1. An inside door handle unit for an automotive vehicle comprising:

a body adapted to be attached to a door of the vehicle;

an inside door handle rotatably supported to said body and pivotal around an axis, said handle being adapted for connection to a door lock device;

a door lock knob rotatably supported to said body and pivotal around an axis, said door lock knob being adapted for connection to the door lock device;

a spring for biasing said handle in one rotational direction of said handle;

first pivot means including first and second counterpart means rotatably engageable with each other to provide a first pivotal connection, said first and second counterpart means forming part respectively of said body and handle and located at a first side of said inside door handle unit, and third and fourth counterpart means rotatably engageable with each other to provide a second pivotal connection, said third and fourth counterpart means forming part respectively of said body and handle and located at a second side of said inside door handle unit, the second side being opposite to the first side, said first to fourth counterpart means being located on the axis around which said handle is pivotal; and second pivot means including fifth and sixth counterpart means rotatably engageable with each other to provide a third pivotal connection, said fifth and sixth counterpart means forming part respectively of said body and said lock knob and located at the first side of said inside door handle unit, and seventh and eight counterpart means rotatably engageable with each other to provide a fourth pivotal connection, said seventh and eighth counterpart means forming part respectively of said body and said lock knob and located at the second side of said inside door handle unit, said fifth to eighth counterpart means being located on the axis around which said lock knob is pivotal, wherein said body includes a generally tub-shaped section formed with a through-hole located near an end of said body; said handle includes a main body section having first and second oppositely disposed portions spaced from each other, said first and second oppositely disposed portions having respectively said second and fourth counterpart means of said first pivot means, and a portion connecting said first and second oppositely disposed portions; said lock knob extending through the through-hole of said body, a part of said lock knob being located between said first and second oppositely disposed portions of said handle; and each of said first to eighth counterpart means of said first and second pivot means is one of a projection and a hole to which said projection is rotatably engageable.

2. An inside door handle unit for an automotive vehicle, comprising:

a body adapted to be attached to a door of the vehicle;

an inside door handle rotatably supported to said body and pivotal around an axis, said handle being adapted for connection to a door lock device;

a door lock knob rotatably supported to said body and pivotal around an axis, said door lock knob being adapted for connection to the door lock device;

a spring for biasing said handle in one rotational direction of said handle;

first pivot means including first and second counterpart means rotatably engageable with each other to provide a first pivotal connection, said first and second counterpart means forming part respectively of said body and handle and located at a first side of said inside door handle unit, and third and fourth counterpart means rotatably engageable with each other to provide a second pivotal connection, said third and fourth counterpart means forming part respectively of said body and handle and located at a second side of said inside door handle unit, the second side being opposite to the first side, said first to fourth counterpart means being located on the axis around which said handle is pivotal; and second pivot means including fifth and sixth counterpart means rotatably engageable with each other to provide a third pivotal connection, said fifth and sixth counterpart means forming part respectively of said body and said lock knob and located at the first side of said inside door handle unit, and seventh and eight counterpart means rotatably engageable with each other to provide a fourth pivotal connection, said seventh and eighth counterpart means forming part respectively of said body and said lock knob and located at the second side of said inside door handle unit, said fifth to eighth counterpart means being located on the axis around which said lock knob is pivotal, wherein said body includes a tub-shaped section formed with a through-hole located near an end of said body; said handle includes a generally U-shaped main body section extending through the through-hole of said body; said lock knob is located inside said main body section of said handle; each of said first to eighth counterpart means of said first and second pivot means is one of a projection and a hole to which said projection is rotatably engageable.

3. An inside door handle unit as claimed in claim 2, further comprising first elastic means by which said first and second counterpart means are elastically brought into engagement with each other, and said third and fourth counterpart means are elastically brought into engagement with each other, and second elastic means by which said fifth and sixth counterpart means are elastically brought into engagement, with each other, and said seventh and eighth counterpart means are elastically brought into engagement with each other.

4. An inside door handle unit as claimed in claim 2, wherein said spring is disposed to extend through the through-hole of said body; and said body includes a cover section disposed to cover an outer peripheral portion of a part of said spring.

5. An inside door handle unit as claimed in claim 2, wherein said handle includes a restriction wall which is located opposite to a wall part of said body, a part of said spring being located between said restriction wall and said wall part of said body so as to be restricted in axial movement.

6. An inside door handle unit as claimed in claim 2, wherein said handle includes a bridge section disposed to connect two leg portions of said main body section so as to form said handle into a generally rectangular frame-shape.

7. An inside door handle unit as claimed in claim 2, wherein said lock knob includes a connecting section to which a rod connected to a door lock device is to be connectable, and a projection formed at a surface thereof to restrict a location of said lock knob upon being guided by a part of said body when said lock knob is installed to said body.

8. An inside door handle unit as claimed in claim 7, wherein said projection is formed to restrict said rod to be positioned at said connecting section when said rod is connected to said connecting section.

9. An inside door handle unit as claimed in claim 8, wherein said projection includes a plurality of ribs which are locatable to extend in a first direction crossing a second direction in which said rod is moved to be connected to said connecting section, said ribs having respective lengths which become larger in said second direction.

* * * * *

UNITED STATES PATENT AND TRADEMARK OFFICE

CERTIFICATE OF CORRECTION

PATENT NO. : 5,794,994

DATED : 08/18/98

INVENTOR(S) :. Masazumi Miyagawa

It is certified that error appears in the above-identified patent and that said Letters Patent is hereby corrected as shown below:

On the Title page, after item [22], please add item
--[30] Foreign Application Priority Data
Aug. 9, 1995 [JP] Japan.....7-203145
Aug. 5, 1996 [JP] Japan.....8-205941 --.

Signed and Sealed this

Twenty-third Day of March, 1999

*Attest:*

Q. TODD DICKINSON

*Attesting Officer*

*Acting Commissioner of Patents and Trademarks*